US006607579B2

(12) United States Patent
Willey et al.

(10) Patent No.: US 6,607,579 B2
(45) Date of Patent: Aug. 19, 2003

(54) APPARATUS AND METHOD FOR PURIFYING AIR

(75) Inventors: Alan David Willey, Cincinnati, OH (US); Vladimir Gartstein, Cincinnati, OH (US); Chinto Benjamin Gaw, Cincinnati, OH (US); Marta Lea Verhoff, Cincinnati, OH (US); James Henry Saunders, Worthington, OH (US); Jean Angela Jefferson, Fairfield, OH (US); Robert Scott Youngquist, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/039,854

(22) Filed: Oct. 29, 2001

(65) Prior Publication Data

US 2002/0185004 A1 Dec. 12, 2002

Related U.S. Application Data

(63) Continuation-in-part of application No. 09/860,288, filed on May 18, 2001, now abandoned.

(51) Int. Cl.[7] ..... B03C 3/013
(52) U.S. Cl. ..... 95/71; 96/27; 96/53; 502/172
(58) Field of Search ..... 96/27, 52, 53; 502/172; 95/71, 72

(56) References Cited

U.S. PATENT DOCUMENTS

| | | | | | |
|---|---|---|---|---|---|
| 2,357,354 | A | * | 9/1944 | Penney | 96/27 |
| 2,357,355 | A | | 9/1944 | Penney | 96/27 |
| 2,525,347 | A | * | 10/1950 | Gilman | 95/71 |
| 2,555,216 | A | | 5/1951 | Wintemute | 96/46 |
| 3,802,625 | A | * | 4/1974 | Buser et al. | 239/704 |
| 3,958,959 | A | | 5/1976 | Cohen et al. | 261/117 X |
| 3,988,128 | A | | 10/1976 | Hogg | 95/64 |
| 4,095,962 | A | | 6/1978 | Richards | 361/227 X |
| 4,239,504 | A | * | 12/1980 | Polizzotti et al. | 95/58 |
| 4,294,588 | A | * | 10/1981 | Polizzotti et al. | 95/58 |
| 4,549,243 | A | | 10/1985 | Owen et al. | 361/228 |
| 4,718,920 | A | | 1/1988 | Kinsey et al. | 95/71 |
| 4,738,690 | A | * | 4/1988 | Radway et al. | 95/58 |

(List continued on next page.)

FOREIGN PATENT DOCUMENTS

| | | |
|---|---|---|
| EP | 1 095 705 A2 | 5/2001 |
| GB | 421 811 A | 12/1934 |
| JP | 2000 354787 | 12/2000 |
| WO | WO 82/01481 A1 | 5/1982 |
| WO | WO 97/28883 A1 | 8/1997 |

*Primary Examiner*—Richard L. Chiesa
(74) *Attorney, Agent, or Firm*—Bart S. Hersko

(57) ABSTRACT

An apparatus for removing particles from air, including an inlet for receiving a flow of air, a first chamber in flow communication with the inlet, wherein a charged spray of semi-conducting fluid droplets having a first polarity is introduced to the air flow so that the particles are electrostatically attracted to and retained by the spray droplets, and an outlet in flow communication with the first chamber, wherein the air flow exits the apparatus substantially free of the particles. The first chamber of the apparatus further includes a collecting surface for attracting the spray droplets, a power supply, and a spray nozzle connected to the power supply for receiving fluid and producing the spray droplets therefrom. The apparatus may also include a second chamber in flow communication with the inlet at a first end and the first chamber at a second end, wherein particles entrained in the air flow are charged with a second polarity opposite the first polarity prior to the air flow entering the first chamber. The second chamber of the apparatus further includes a power supply, at least one charge transfer element connected to the power supply for creating an electric field in the second chamber, and a ground element associated with the second chamber for defining and directing the electric field, wherein the air flow passes between the charge transfer element and the ground element.

36 Claims, 12 Drawing Sheets

U.S. PATENT DOCUMENTS

| | | | | | |
|---|---|---|---|---|---|
| 4,776,515 | A | | 10/1988 | Michalchik | 239/3 |
| 5,213,595 | A | | 5/1993 | Kim | 96/27 |
| 5,290,600 | A | | 3/1994 | Ord et al. | 222/566 X |
| 5,310,416 | A | * | 5/1994 | Borger et al. | 95/64 |
| 5,337,963 | A | | 8/1994 | Noakes | 239/690 |
| 5,503,335 | A | | 4/1996 | Noakes et al. | 239/690 |
| 5,518,525 | A | * | 5/1996 | Steed | 95/58 |
| 5,843,210 | A | * | 12/1998 | Paranjpe et al. | 95/59 |
| 5,902,380 | A | * | 5/1999 | Tomimatsu et al. | 96/27 |
| 5,914,454 | A | * | 6/1999 | Imbaro et al. | 95/64 |
| 5,958,361 | A | * | 9/1999 | Laine et al. | 423/592 |
| 5,980,614 | A | | 11/1999 | Loreth et al. | 96/63 |
| 6,156,098 | A | | 12/2000 | Richards | 95/65 |
| 6,500,240 | B1 | * | 12/2002 | Tomimatsu et al. | 96/27 |

* cited by examiner

APPARATUS AND METHOD FOR PURIFYING AIR

CROSS-REFERENCE TO RELATED APPLICATIONS

The present application is a continuation-in-part to a previous application entitled "System and Method For Purifying Air," filed on May 18, 2001, now abandoned, and having Ser. No. 09/860,288.

FIELD OF THE INVENTION

The present invention relates generally to an apparatus and method for purifying air, and, more particularly, to an apparatus and method for removing particles of a specified size from an air flow by attracting such particles to charged spray droplets of a fluid introduced to the air flow.

BACKGROUND OF THE INVENTION

Indoor air includes many small particles which, when inhaled or otherwise contacted by human beings, have a pernicious effect. Dust alone comprises dead skin, dust mite feces, pet dander, and other microscopic (less than 10 microns in size) particles which elicit a human immune response. This is exemplified by dust mite feces, which comprise a wide array of serine and cysteine protease enzymes that cause respiratory irritation and are responsible for many allergy symptoms.

While filtration systems have been used to reduce the amount of small particles present in selected locations, many of the most commonly irritating materials still exist as particles within a range of about 0.1 micron to about 10 microns in size. Filters having pore openings small enough to be effective at removing particles in this size range are known to become easily occluded and generate high backpressure, thereby requiring high power air blowers. Moreover, the ability to maintain proper air conduction through such filters requires a significant amount of electrical energy, is expensive and cumbersome.

Other types of air purifying devices, such as ionic and electrostatic devices, utilize the charge on particles to attract them to a specified collecting surface which is charged at an opposite polarity. Such devices require the collecting surface to be cleaned constantly and have met with limited success in terms of efficiency.

It will be appreciated that small particles can collect in the home and be rebreathed by the occupants without the benefit of elaborate and high power consumption filtration systems found in the public domain. One vestige of prior art systems is their size and high electrical power demand, which affects the cost of operation and the aesthetics of a sizable filtration apparatus.

Accordingly, it is desirable that an apparatus and method of purifying air be developed which is capable of removing particles of a specified size (about 0.1 micro to about 10 microns) in a manner which is adaptable, non-intrusive, and ergonomically compatible. It is also desirable that a fluid, as well as the requisite attributes thereof, be determined for use with the apparatus and method of purifying air which satisfies the electrical and sprayability demands required for use as the spray.

SUMMARY OF THE INVENTION

In accordance with a first aspect of the present invention, an apparatus for removing particles from air is disclosed as including at least one inlet for receiving a flow of air, a first chamber in flow communication with the inlet, wherein a charged spray of semi-conducting fluid droplets having a first polarity is introduced to the air flow passing therethrough so that the particles are electrostatically attracted to and retained by the spray droplets, and an outlet in flow communication with the first chamber, wherein the air flow exits the apparatus substantially free of the particles. The first chamber of the apparatus further includes a collecting surface for attracting the spray droplets, a power supply, and a spray nozzle connected to the power supply for receiving fluid, producing the spray droplets therefrom, and charging the spray droplets.

In accordance with a second aspect of the present invention, the apparatus may also include a second chamber in flow communication with the inlet at a first end and the first chamber at a second end, wherein particles entrained in the air flow are charged with a second polarity opposite the first polarity prior to the air flow entering the first chamber. The second chamber of the apparatus further includes a power supply, at least one charge transfer element connected to the power supply for creating an electric field in the second chamber, and a ground element associated with the second chamber for defining and directing the electric field, wherein the air flow pases between the charge transfer element and the ground element.

In accordance with a third aspect of the present invention, the apparatus may further include a fluid recirculation system in flow communication with the first chamber for providing the fluid from the collecting surface to the spray nozzle. The fluid recirculation system includes a device in flow communication with the collecting surface, a reservoir in flow communication with the device, and a pump for providing the fluid to the spray nozzle. The fluid recirculation system may also include a filter positioned between the collecting surface and the pump for removing the particles from the fluid, as well as a device for monitoring the quality of the fluid prior to being pumped to the spray nozzle. A replaceable cartridge may be utilized to house the reservoir, where the cartridge includes an inlet in fluid communication with the collecting surface of the first chamber at a first end and the reservoir at a second end and an outlet in fluid communication with the reservoir at a first end and the pump at a second end.

In accordance with a fourth aspect of the present invention, an apparatus for removing particles from air is disclosed as including at least one defined passage having an inlet and an outlet, wherein each inlet receives a flow of air and the air flow exits the passage at each outlet, and a first area positioned between each inlet and each outlet where a charged spray of semi-conducting fluid droplets having a first polarity is introduced within the passage so that particles entrained within the air flow are electrostatically attracted to and retained by the spray droplets. The apparatus further includes a collecting surface associated with the first area of the passage for attracting the spray droplets, as well as a spray nozzle associated therewith for receiving fluid, producing the spray droplets in the first area of the passage, and charging the spray droplets. The apparatus may also include a second area positioned between the inlet and the first area, wherein particles entrained in the air flow are charged with a second polarity opposite the first polarity. The second area includes at least one charge transfer element associated therewith for creating an electric field in the second area of the passage, as well as a ground element associated therewith for defining and directing the electric field in the second area of the passage.

In accordance with a fifth aspect of the present invention, a method of removing particles from air is disclosed as including the steps of introducing a flow of air having particles entrained therein into a defined area and providing a charged spray of semi-conducting fluid droplets having a first polarity to the defined area, wherein the particles are electrostatically attracted to and retained by the spray droplets, and attracting the spray droplets to a collecting surface. The method further includes the steps of forming the spray droplets from the fluid and charging the spray droplets. The method preferably includes the step of providing a charge to particles in the air flow at a second polarity opposite of the first polarity. The method may further include one or more of the following steps: filtering the air flow for particles having a size greater than a specified size; monitoring quality of the air flow; filtering the particles from the spray droplets; collecting the spray droplets in an aggregate of the fluid; recirculating the fluid aggregate for use in the spray; and, monitoring quality of the recirculated liquid prior to forming the spray.

In accordance with a sixth aspect of the present invention, a cartridge for use with an air purifying apparatus, wherein a charged spray of semi-conducting fluid droplets is introduced to an air flow and collected so as to form a fluid aggregate, is disclosed as including a housing having an inlet and an outlet and a reservoir for retaining the fluid aggregate in flow communication with the inlet at a first end and the outlet at a second end. The cartridge may also include a filter located between the inlet and the reservoir, as well as a pump located between the reservoir and the outlet. The cartridge is configured for the inlet to be in flow communication with the collected fluid aggregate and the outlet to be in flow communication with a device for forming the fluid droplets in the air purifying apparatus. The cartridge housing may function as a collecting surface for the air purifying apparatus and include a spray nozzle associated therewith.

In accordance with a seventh aspect of the present invention, a fluid is disclosed for use as a spray in an air purifying apparatus, wherein particles in an air flow entering the air purifying apparatus are electrostatically attracted to droplets of the spray. The fluid has physical properties which enable a sprayability factor according to a designated algorithm within a specified range, where the sprayability factor is a function of certain physical properties of the fluid which relate to spray droplet size able to be formed and coverage and effectiveness of the spray. Such physical properties of the fluid include flow rate, density, resistivity, surface tension, dielectric constant, and viscosity. The sprayability factor also may be a function of an electric field formed in the air purifying apparatus to which the fluid is introduced. The fluid preferably is semi-conducting, nonaqueous, inert, non-volatile and non-toxic.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention.

Figure 1:
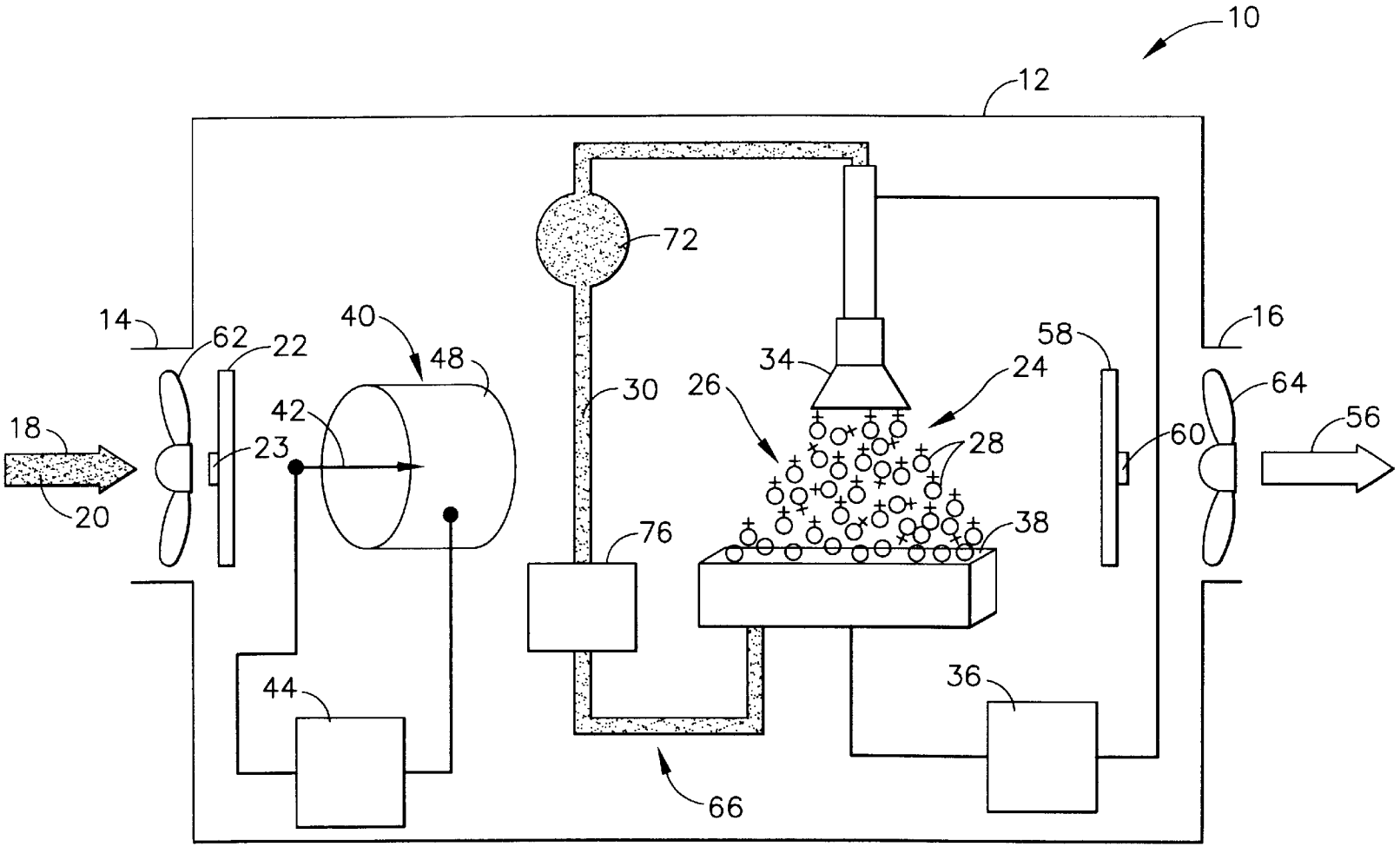
FIG. 1 is a diagrammatic view of a first embodiment for the air purification system of the present invention, where the flow of air into the system crosses the direction of the fluid spray therein.

As seen in FIG. 1, an apparatus 10 for purifying air includes a housing 12 having an inlet 14 and an outlet 16. It will be seen that inlet 14 is configured to receive an air flow designated generally by reference numeral 18. Air flow 18 is considered to be dirty air in the sense that it includes certain particles (identified by reference numeral 20) therein that are within a specified size range (approximately 0.1 micron to approximately 10 microns). A filter 22 is preferably included adjacent inlet 14 in order to prevent particles greater than the specified size from entering apparatus 10. A sensor 23 may also be located adjacent inlet 14 for monitoring the quality of air entering apparatus 10.

More specifically, apparatus 10 includes a first chamber or defined area 24 in flow communication with inlet 14 in which a charged spray 26 of semi-conducting fluid droplets 28 having a first polarity (i.e., positive or negative) is introduced to air flow 18 passing therethrough to outlet 16. Spray droplets 28 are preferably distributed in a substantially homogenous manner within first chamber 24 so that particles 20 become electrostatically attracted to and retained by spray droplets 28. It will be seen that first chamber 24 includes a first device for forming spray droplets 28 from a semi-conducting fluid 30 supplied thereto and a second device for charging such spray droplets 28. It will be appreciated, however, that the charging device may perform its function either prior or subsequent to formation of spray droplets 28 by the first device.

Preferably, a spray nozzle 34 connected to a power supply 36 (approximately 18 kilovolts) is provided to serve the function of the first and second devices so that it receives the semi-conducting fluid, produces spray droplets 28 therefrom, and charges such spray droplets 28. A collecting surface 38 spaced a predetermined distance from spray nozzle 34 is also provided in first chamber 24 to attract spray droplets 28, as well as particles 20 retained therewith. In this way, particles 20 are removed from air flow 18 circulating through apparatus 10. It will be appreciated that collecting surface 38 is either grounded or charged at a second polarity opposite the first polarity of spray droplets 28 to enhance attraction thereto. In order for apparatus 10 to perform in an effective manner, the charge on spray droplets 28 is preferably maintained until striking collecting surface 38, whereupon such charge is neutralized.

Figure 4:
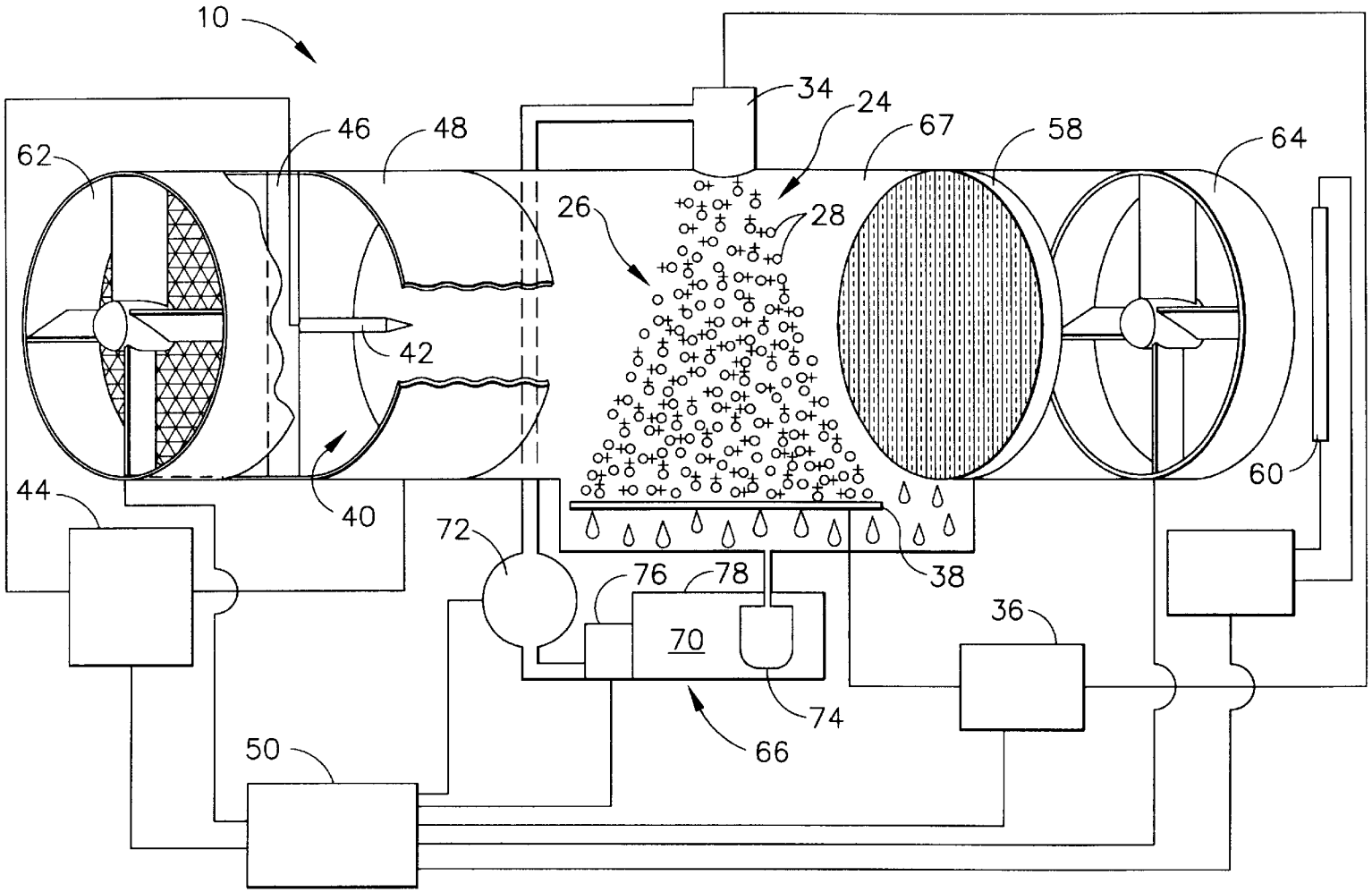
FIG. 4 is a diagrammatic view of the air purification system depicted in FIG. 1 within a defined passage.

Apparatus 10 preferably includes a second chamber or defined area 40 in flow communication with inlet 14 at a first end and first chamber 24 at a second end, wherein particles 20 entrained in air flow 18 are charged with a second polarity opposite the first polarity of spray droplets 28 prior to air flow 18 entering first chamber 24. In order to provide such charge, an electric field in second chamber 40 is preferably created by at least one charge transfer element 42 (e.g., a charging needle) connected to a power supply 44 (providing, for example, approximately 8.5 kilovolts). While charge transfer element 42 may be oriented in any number of directions, it is preferred that it be mounted within second chamber 40 so as to be substantially parallel to air flow 18. This may be accomplished as shown in FIG. 4 by a central support element 46 extending across second chamber 40. It will be appreciated that central support element 46 may be configured in any number of ways so long as it provides the required support for charge transfer element 42 and permits air flow 18 to move unencumbered through second chamber 40.

Second chamber 40 further includes a ground element 48 associated therewith for defining and directing the electric field created therein. It will be appreciated that air flow 18 passes between charge transfer element 42 and ground element 48. A collecting surface may also be associated with second chamber 40, where such collecting surface could be charged by charge transfer element 42 so as to be of opposite polarity to spray droplets 28 and thereby create an attraction. In order to better effect the charge on particles 20, a device may be provided in second chamber 40 for creating a turbulence in air flow 18 therein.

Turning back to first chamber 24, it will be understood that various configurations and designs may be utilized for spray nozzle 34 and collecting surface 38, but they should be matched so as to maintain a substantially uniform electric field in first chamber 24. Accordingly, when spray nozzle 34 is axisymmetric, collecting surface 38 preferably takes the form of a ring washer, a funnel, a perforated disk, or a cylinder of wire mesh as shown in FIGS. 6–9, respectively. It will be understood that collecting surface 38 preferably is a solid plate, solid bar, or perforated plate design when spray nozzle 38 is linear.

Figure 10:
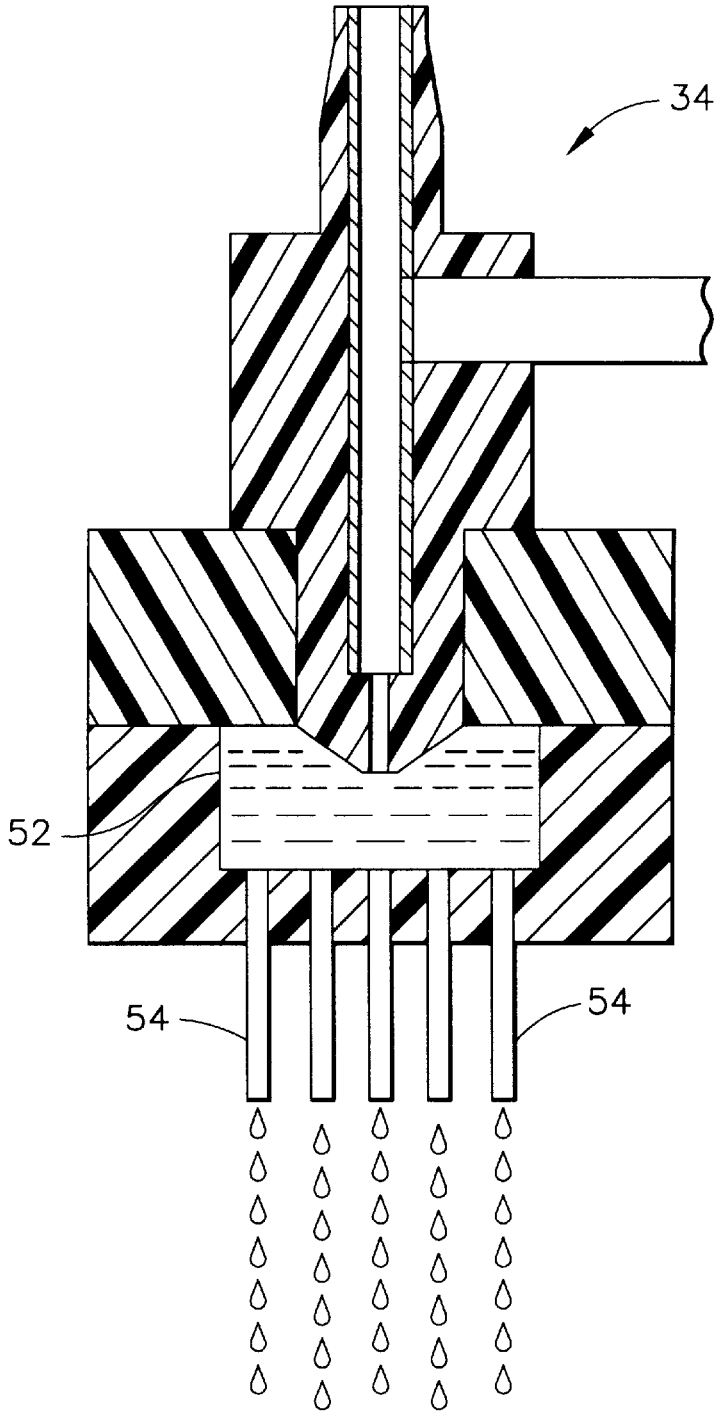
FIG. 10 is a side view of an exemplary multi-nozzle design for a spray nozzle which may be utilized in the first chamber of the air purification system depicted in FIGS. 1–4.
Figure 11A:
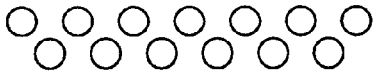
FIGS. 11A–11H are diagrammatic views of exemplary tube patterns for the multi-nozzle design depicted in FIG. 10.
Figure 11B:
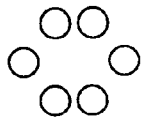
Figure 11C:
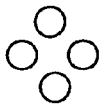
Figure 11D:
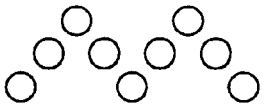
Figure 11E:
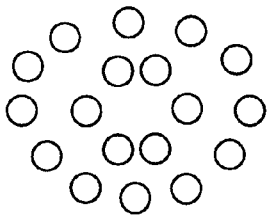
Figure 11F:
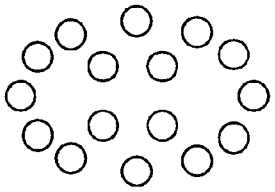
Figure 11G:
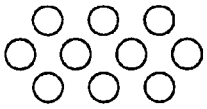
Figure 11H:
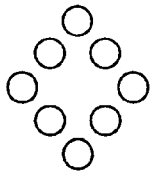

Another exemplary design for spray nozzle 34 is one where a multi-nozzle configuration is utilized. This may take the form of a Delrin body 52 with a plurality of spray tubes 54 in flow communication with such Delrin body 52 at a first end and first chamber 24 at a second end (see FIG. 10). It will be appreciated that any number of flow patterns may be provided by spray nozzle 34 when employing a multi-nozzle design as shown, for example, in FIGS. 11A–11H.

Figure 14:
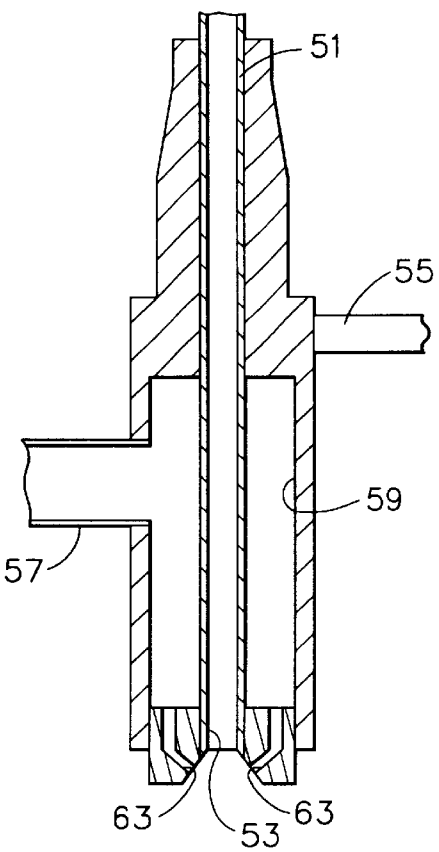
FIG. 14 is a side view of a third spray nozzle design utilized in the first chamber of the air purification system including an air assist passage around the charging tube.
Figure 13:
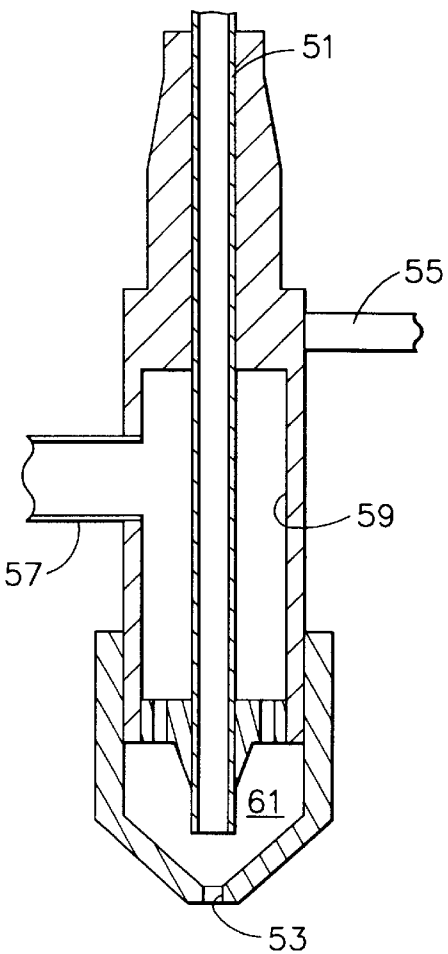
FIG. 13 is a side view of a second spray nozzle design utilized in the first chamber of the air purification system including an air assist passage around the charging tube.
Figure 12:
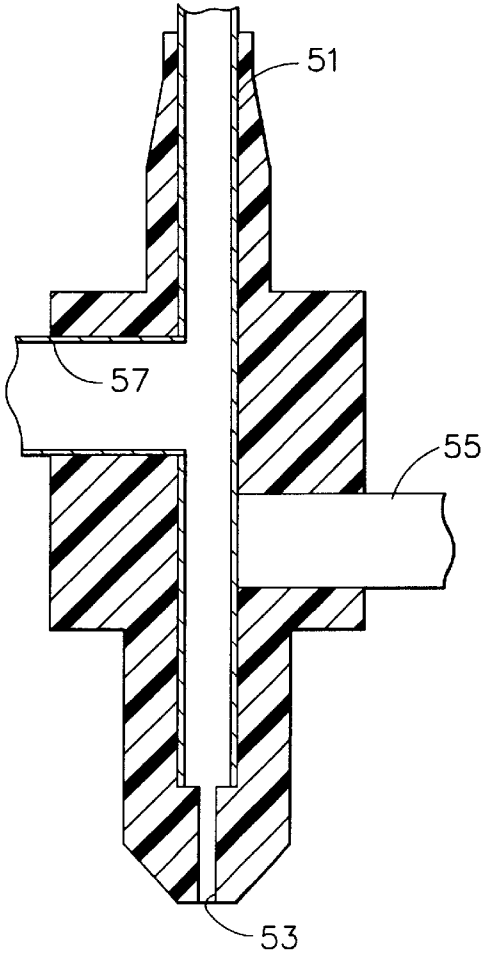
FIG. 12 is a side view of a first spray nozzle design utilized in the first chamber of the air purification system including an air assist passage in flow communication with the charging tube.
Figure 15:
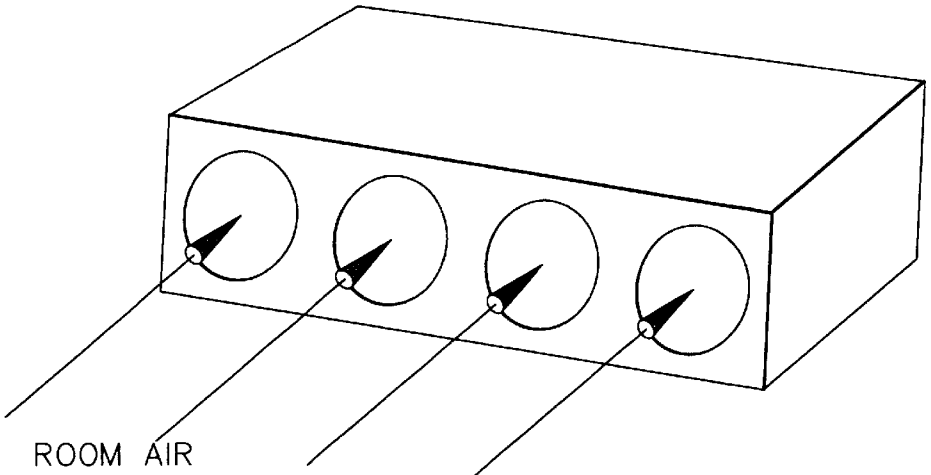
FIG. 15 is a diagrammatic perspective view of an air purification system having a plurality of defined passages therein as depicted in FIG. 4.
Figure 16:
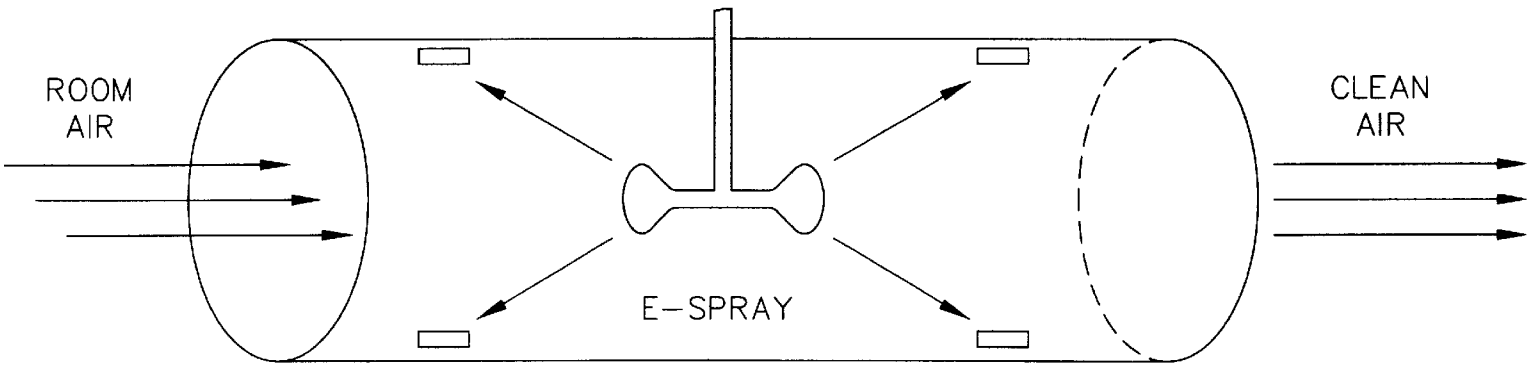
FIG. 16 is a diagrammatic side view of an air purification system where a defined passage has a plurality of collecting electrodes positioned therein.
Figure 17:
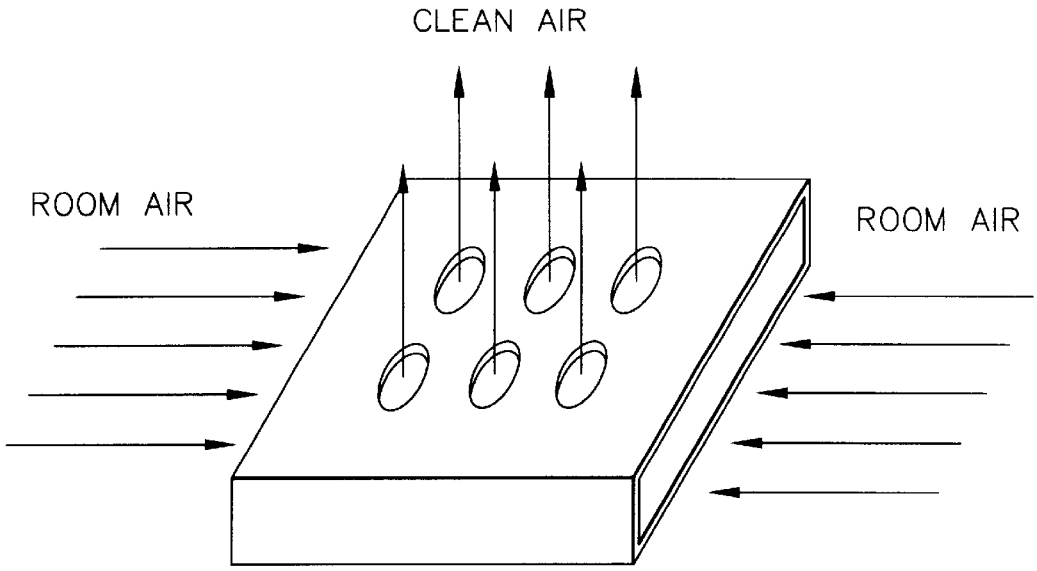
FIG. 17 is a diagrammatic perspective view of an air purification system like that depicted in FIG. 1 having a plurality of inlets and an outlet oriented at an angle thereto.
Figure 18:
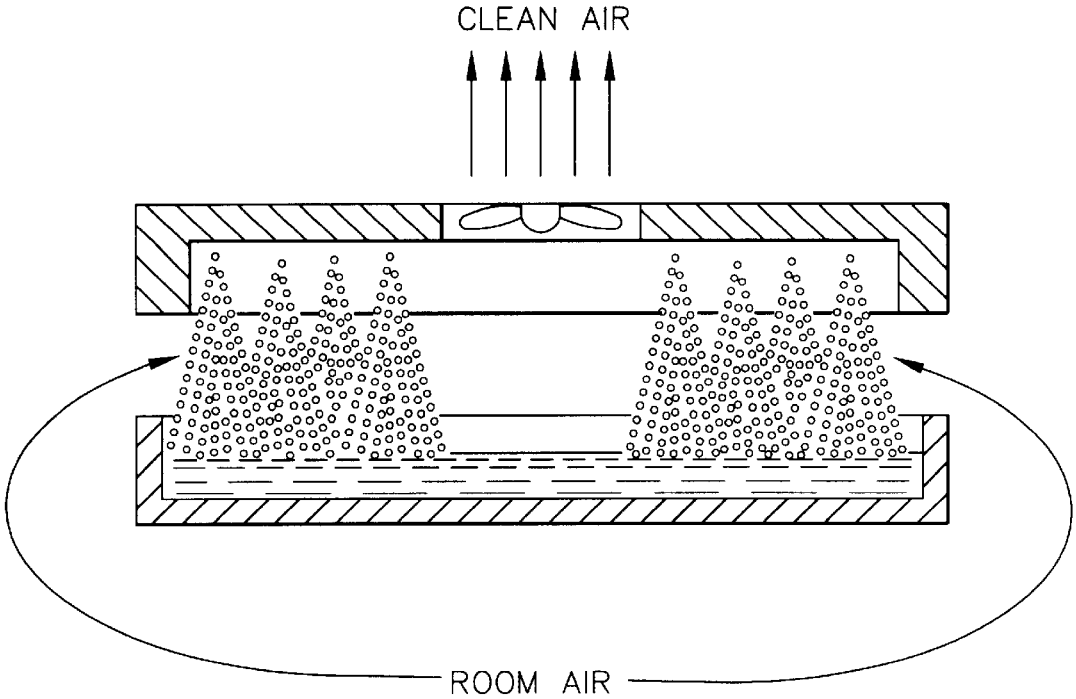
FIG. 18 is a diagrammatic side view of the air purification system depicted in FIG. 17 to indicate the pattern of the fluid spray therein.

It will be appreciated that spray droplets 28 may be produced in various ways from fluid 30. Since a high relative velocity is required between fluid 30 to be atomized and the surrounding air or gas, this can be accomplished by discharging fluid 30 at high velocity into a relatively slow moving stream of air or gas or exposing a relatively slow moving fluid to a high velocity air stream. Accordingly, those skilled in the art will understand that pressure atomizers, rotary atomizers, and ultrasonic atomizers may be utilized. Another device involves a vibrating capillary to produce uniform streams of drops. As seen in FIGS. 12–14, the present invention contemplates the use of air-assist type atomizers. In this type of spray nozzle, semiconducting fluid 30 is exposed to a stream of air flowing at high velocity. This may occur as part of an internal mixing configuration where the gas and fluid mix within the nozzle before discharging through the outlet orifice (see FIGS. 12 and 13) or an external mixing configuration where the gas and fluid mix at the outlet orifice (see FIG. 14).

While each spray nozzle configuration preferably includes a main conduit 51 through which the semi-conducting fluid flows to an outlet orifice 53, as well as a charging element 55 connected to main conduit 51 for providing the desired charge to fluid/spray droplets 28 therein, it will be seen that a passage 57 also provides air to spray nozzle 34. In FIG. 12, passage 57 is in direct flow communication with main conduit 51 so as to mix fluid and air before exiting outlet orifice 53. FIGS. 13 and 14 depict passage 57 as being in flow communication with an internal cavity 59, whereupon the air provided therethrough is mixed with the fluid in either a separate cavity 61 before exiting outlet orifice 53 (FIG. 13) or as fluid is exiting outlet orifice 53 via separate passages 63 in flow communication with internal cavity 59 and located adjacent to outlet orifice 53 (FIG. 14). An exemplary spray nozzle utilizing air assistance is one designated as Model SW750 manufactured by Seawise Industrial Ltd.

Figure 2:
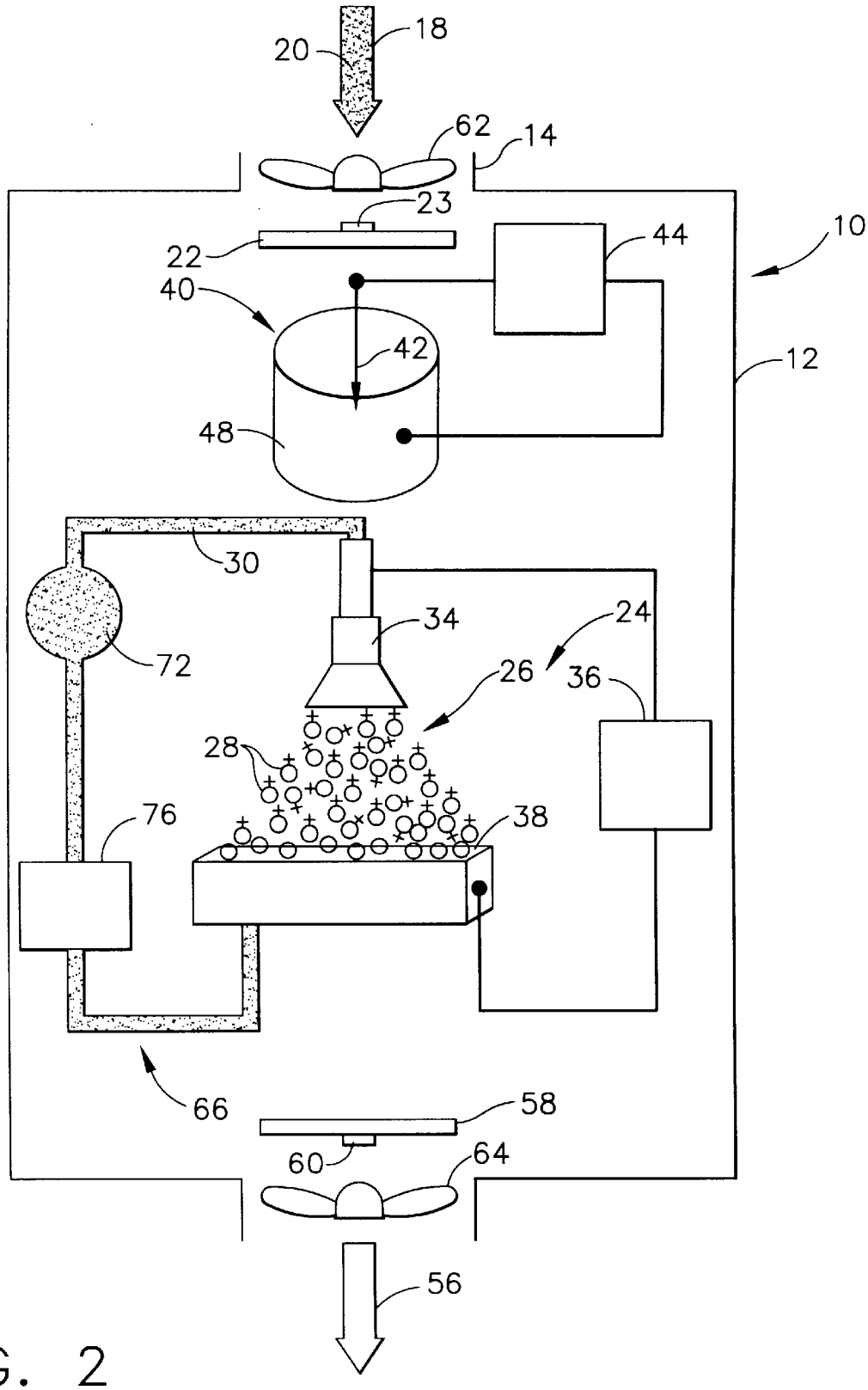
FIG. 2 is a diagrammatic view of a second embodiment for the air purification system of the present invention, where the flow of air into the system is in substantially the same direction as the fluid spray therein.
Figure 3:
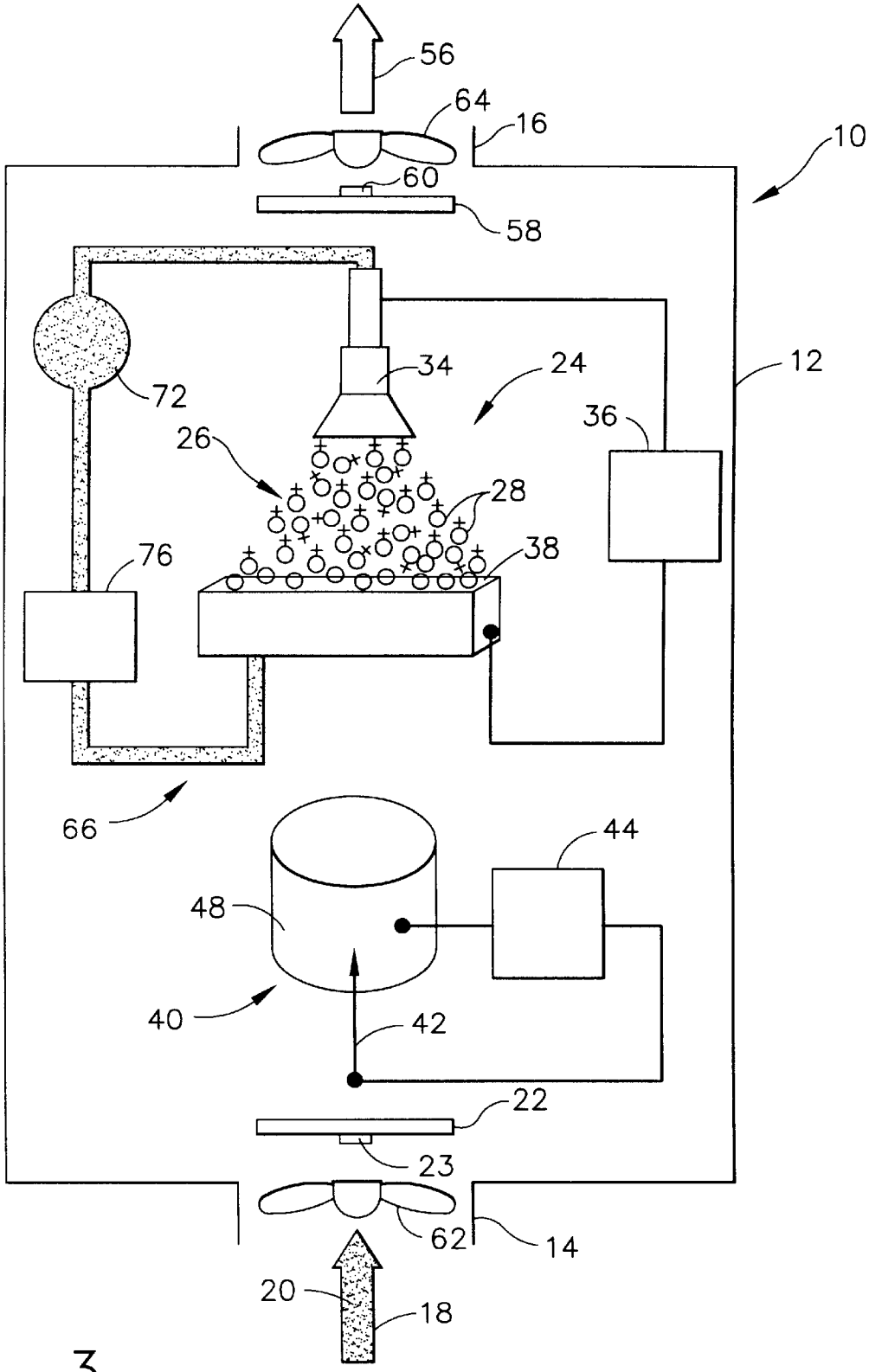
FIG. 3 is a diagrammatic view of a third embodiment for the air purification system of the present invention, where the flow of air into the system is substantially opposite to the direction of the fluid spray therein.

Regardless of the configuration for spray nozzle 34 and collecting surface 38, it will be understood that spray droplets 28 are preferably distributed in a substantially homogeneous manner within first chamber 24. It has been determined that spray droplets 28 preferably should enter first chamber 24 at substantially the same velocity as air flow 18. Spray nozzle 34 may also be oriented in different manners so that spray droplets 28 flow in a direction substantially the same as the direction of air flow 18 (see FIG. 2), substantially opposite to the direction of air flow 18 (see FIG. 3), or at an angle (e.g., substantially perpendicular) to the direction of air flow 18 (see FIG. 1). The size of spray droplets 28 is an important parameter relative to the size of particles 20. Accordingly, spray droplets 28 preferably have a size in a range of approximately 0.1–1000 microns, more preferably in a range of approximately 1.0–500 microns, and most preferably in a range of approximately 10–100 microns.

Outlet 16 of housing 12 is then in flow communication with first chamber 24 so that air flow directed therethrough (designated by arrow 56) is substantially free of particles 20. A filter 58 may also be provided adjacent outlet 16 in order to remove any spray droplets 28 which are not attracted by collecting surface 38 in first chamber 24. A sensor 60 is preferably provided at outlet 16 for monitoring the quality of air flow 56 upon exiting apparatus 10. Moreover, in order to balance efficiency of apparatus 10 with the ability to substantially remove particles 20 from air flow 18, it will be appreciated that air flow 18 have a predetermined rate of flow through apparatus 10. To better maintain a desired flow rate, inlet 14 and/or outlet 16 also may include a device 62 or 64, such as a fan, to assist in pushing or drawing air flow 18 from inlet 14 through first and second chambers 24 and 32, respectively.

A control unit 50 (see FIG. 4) is provided in order to operate apparatus 10, and, more specifically, power supply 36, power supply 44, fan 62, and fan 64. Additionally, control unit 50 is connected to sensors 60 for monitoring the quality of air exiting apparatus 10 and sensor 76 for monitoring the quality and flow rate of fluid 30 recirculated through fluid recirculation system 66.

It will also be seen from FIGS. 1–4 that a fluid recirculation system 66 is preferably in flow communication with collecting surface 38 so as to capture fluid 30 aggregated from spray droplets 28 and provide it back to spray nozzle 34 for continuous use. In particular, fluid recirculation system 66 includes a device for collecting fluid 30 from collecting surface 38 and a wall 67, defining first chamber 24. This fluid collection mechanism preferably is incorporated into collecting surface 38, as exemplified by the openings in the configurations depicted in FIGS. 6–9. Fluid recirculation system 66 also includes a reservoir 70 in flow communication with device for storing fluid 30 (aggregated at collecting surface 38 from spray droplets 28) and a pump mechanism 72 for providing such fluid 30 to spray nozzle 34.

It will be appreciated that fluid recirculation system 66 also preferably includes a filter 74 positioned between collecting surface 38 and spray nozzle 34 for removing particles 20 from fluid 30. This assists in keeping fluid 30 more pure and prevent possible occlusion in spray nozzle 34. A device 76 may be provided in association with filter 74 to monitor the quality of fluid 30 prior to being pumped to spray nozzle 34, whereby device 76 is able to indicate when such fluid 30 should be replaced.

Figure 5:
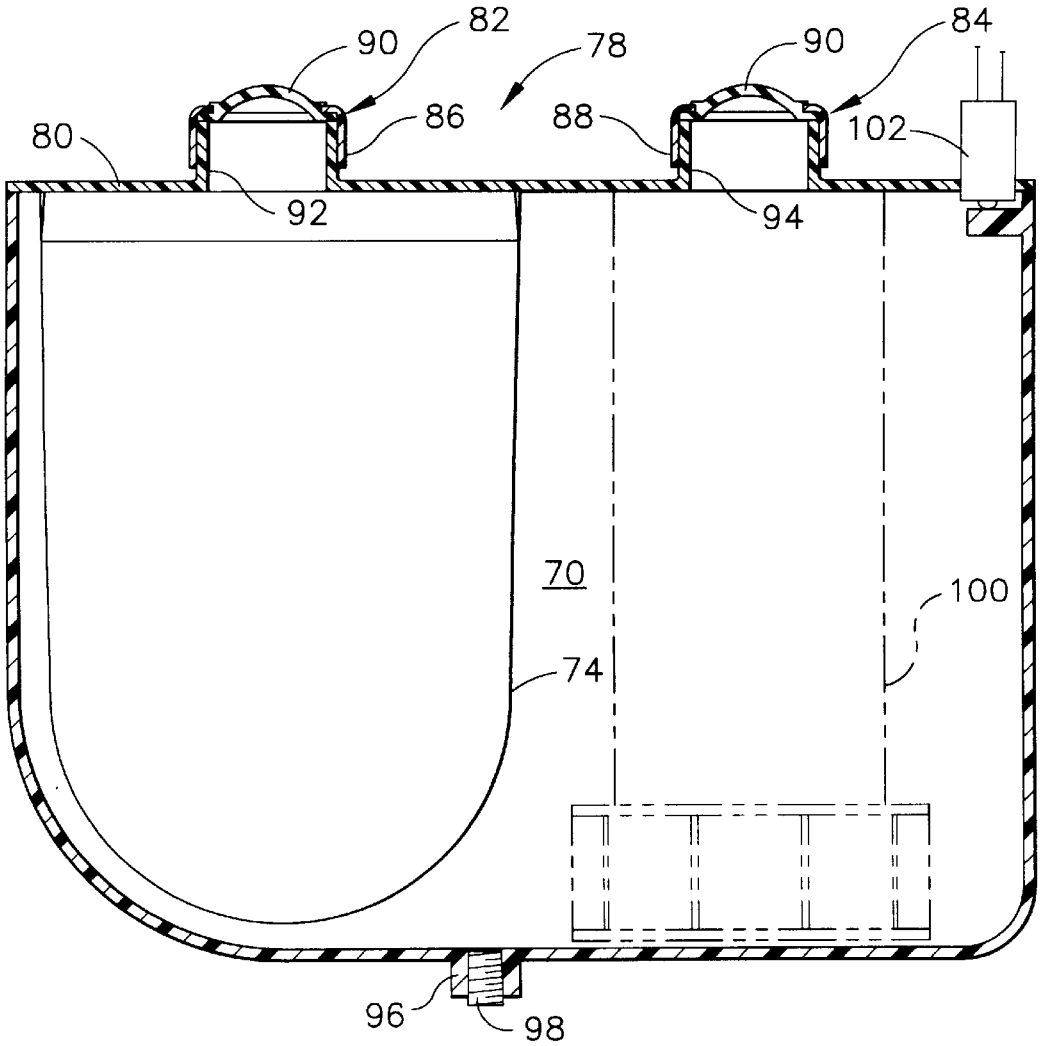
FIG. 5 is a cross-sectional view of the disposable cartridge depicted in FIG. 4.
Figure 6A:
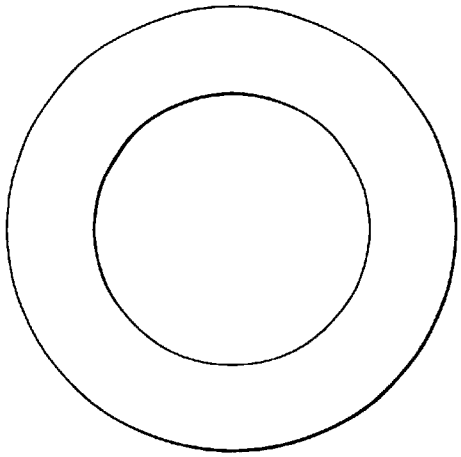
FIG. 6A is a top view of an exemplary collecting device utilized with an axisymmetric spray nozzle in a first chamber or area of the air purification system depicted in FIGS. 1, 4 and 5.
Figure 6B:
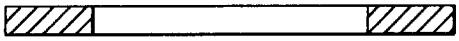
FIG. 6B is a side view of the collecting device depicted in FIG. 6A.
Figure 8A:
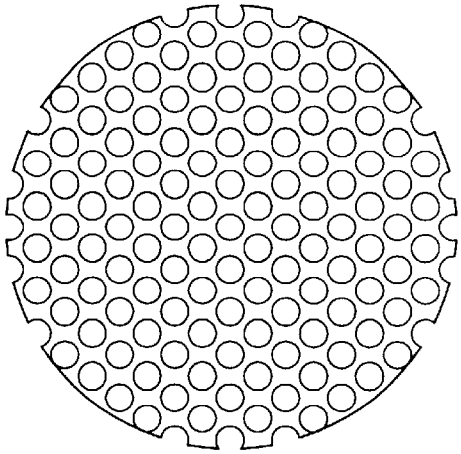
FIG. 8A is a top view of an exemplary collecting device utilized with an axisymmetric spray nozzle in a first chamber or area of the air purification system depicted in FIGS. 2 and 3.
Figure 8B:
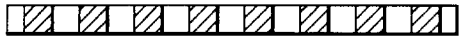
FIG. 8B is a side view of the collecting device depicted in FIG. 8A.
Figure 7A:
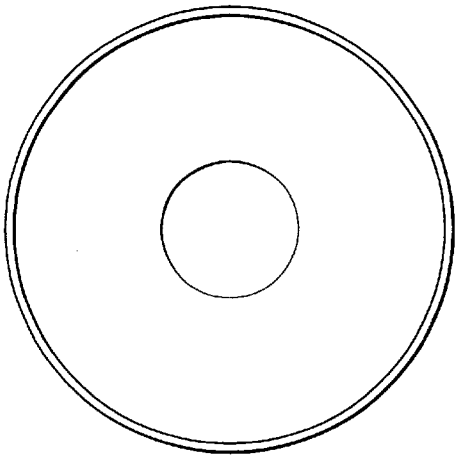
FIG. 7A is a top view of an exemplary collecting device utilized with an axisymmetric spray nozzle in a first chamber or area of the air purification system depicted in FIGS. 1, 4 and 5.
Figure 7B:
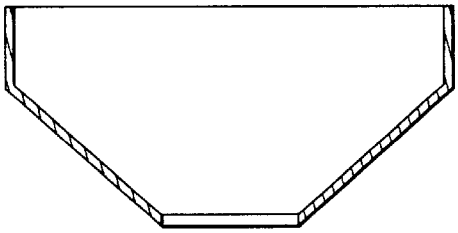
FIG. 7B is a side view of the collecting device depicted in FIG. 7A.
Figure 9A:
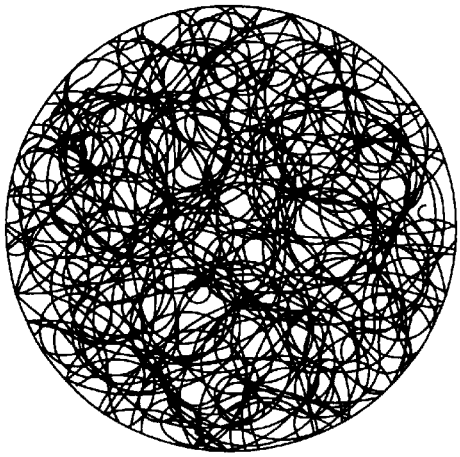
FIG. 9A is a top view of an exemplary collecting device utilized with an axisymmetric spray nozzle in a first chamber or area of the air purification system depicted in FIGS. 2 and 3.
Figure 9B:
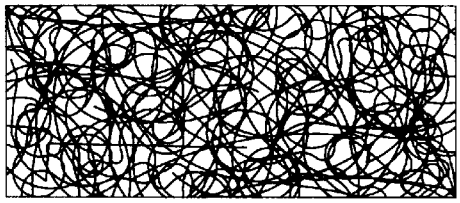
FIG. 9B is a side view of the collecting device depicted in FIG. 9A.

In a preferred embodiment of fluid recirculation system 66 depicted in FIG. 5, a disposable cartridge 78 is utilized to house at least a portion thereof. This permits semi-conducting fluid 30 used for spray droplets 28 to be easily replaced when desired. More specifically, cartridge 78 includes a housing 80 having an inlet 82 in flow communication with collecting surface 38 at a first end and reservoir 70 at a second end. An outlet 84 is also provided in cartridge housing 80 which is in flow communication with reservoir 70 at a first end and pump mechanism 72 at a second end. As seen in FIG. 5, a filter 74 may be contained within cartridge housing 80 so that fluid 30 flows therethrough prior to entering reservoir 70. Alternatively, filter 74 may be positioned so that fluid 30 first enters reservoir 70. It will be appreciated that monitoring device 76 may or may not be included within cartridge 78, but should be positioned upstream of pump mechanism 72. If provided with cartridge 78, monitoring device 76 preferably will indicate when fluid 30 therein should be replaced. Inlet 82 and outlet 84 of cartridge housing 80 each are shown to have a cap portion 86 and 88, respectively, which extends from housing 80 and preferably has a self-sealing membrane 90 covering a passage 92 and 94 through each respective cap portion.

Preferably, cartridge 78 is configured so that inlet 82 is in flow communication with fluid 30 aggregated by collecting surface 38. Indeed, a portion of housing 80 may itself function as collecting surface 38. Likewise, cartridge 78 will preferably be configured so that outlet 84 is in flow communication with spray nozzle 34 or a spray nozzle integral therewith. An opening 96 with a corresponding removable plug member 98 is preferably provided in housing 80 so that fluid 30 is permitted to be drained from reservoir 70 when considered too dirty or impure. New fluid can also be replaced in reservoir 70 by such means.

It will be appreciated that a pump (identified in phantom by reference numeral 100 in FIG. 5) may be positioned within cartridge 78 to assist in moving fluid 30 through outlet 84. It is also optional for a switch 102 to be integrated with cartridge 78 so that apparatus 10 will not operate when a cartridge is not positioned therein. Similarly, cartridge 78 may be configured in a specified way so that only cartridges having such configuration are identified as being acceptable for use.

It has been found that apparatus 10, and particularly the size, density and charge of spray droplets 28 formed in first chamber 24 by spray nozzle 34, is preferably designed so as to satisfy an efficiency design parameter EDP within a specified range. Present experience has found that an efficiency design parameter within a range of approximately 0.0–0.6 is acceptable, while a range of approximately 0.0–0.3 is preferred and a range of approximately 0.0–0.15 is considered optimal. This efficiency design parameter is preferably calculated as a function of several parameters. The first component is a charge dependent parameter CDP calculated by the following formula when both particles 20 and spray droplets 28 are charged (i.e., K=1):

$$CDP=10^{aL+bL-cL-dL+25.45}$$

When only spray droplets 28 are charged (K=−1), then the charge dependent parameter is preferably calculated by the following:

$$CDP=[(10^{2*aL+2*bL-PL-dL+18.26})^{0.4}]+1$$

where a=charge per unit area of the electrostatically sprayed particles 20 (units of coulombs per square centimeter)

b=charge of particles 20 to be collected (units of coulombs)

c=diameter of particles 20 to be collected (units of microns)

d=relative velocity between particles 20 and spray droplets 28 (units of meter per second)

P=diameter of spray droplets 28 (units of microns)

It will be appreciated that aL, bL, cL, dL and PL are the logarithms of the aforementioned respective variables.

A second component of efficiency design parameter EDP is a dimensionless parameter $N_D$ which is preferably calculated according to the following formula:

$$N_D_P^3Q/(-1.910\times10^{12}+P^3Q)$$

where

P=diameter of spray droplets 28 (units of microns)

Q=number of spray droplets 28 (units of particles per centimeter cubed)

The efficiency design parameter EDP is then preferably determined from the following equation:

$$EDP=exp[(N_D\times CDP\times W\times38100)/(P\times Z)]$$

where $N_D$=dimensionless parameter

CDP=charge dependent parameter (dimensionless)

W=linear distance in direction of air flow 18 from the point the air first contacts the spray to the point where air exits the spray (units of inches)

P=diameter of spray droplets 28 (units of microns)

Z=a velocity dependent parameter (dimensionless)

It will be appreciated that velocity dependent parameter Z is equal to one when air flow 18 moves in either substantially the same direction as or substantially opposite to the flow direction of spray droplets 28. Should the flow of spray droplets 28 be at an angle to air flow 18, velocity dependent parameter Z is determined as:

$$Z=\cos[arctan\times V_2/V_1)].$$

In order to appreciate better how calculation of efficiency design parameter EDP is performed, an exemplary calculation is determined where removal of 1 micron aerosol particles from an air flow using a spray of electrostatically charged 10 micron spray droplets having a density of 500 particles/cm$^3$ is desired. The aerosol particles enter the spray in air that has a speed of 2.1 meters per second. The spray droplets travel to collecting surface 38 at a speed of 2 meters per second and their travel is in the same direction as air flow 18. The aerosol particles 20 are corona charged in second chamber 40 prior to entering spray 26 and have a charge of $6\times10^{-17}$ coulomb. Electrostatically charged spray droplets 28 have a charge per unit area of $9.5\times10^{-9}$ coulomb per square centimeter and spray 26 extends over a distance of 2 inches.

With regard to the information supplied for the example above,

| | |
|---|---|
| P = 10 | PL = 1.0 |
| Q = 500 | |
| W = 2 | |
| Z = 1 | |
| a = $1.7\times10^{-8}$ C/cm$^2$ | aL = −7.77 |
| b = $6\times10^{-17}$ C | bL = −16.22 |
| c = 1 micron | cL = 0 |
| d = 0.1 m/s | dL = −1 |
| K = +1 | |
| CDP = $10^{aL+bL-cL-dL+25.45}$ = 281 | |
| $N_D$ = $-2.62\times10^{-7}$ | |
| EDP = exp [{($-2.62\times10^{-7}$) × (281) × (2) × 38100}/{(10) × (1)}] = 0.57 | |

While the design in the aforementioned example is considered to be within an acceptable range, it will be seen that modifications to such example where the spray density is 2000 particles per centimeter cubed and the spray droplets are 30 microns in size enable the charge dependent parameter CDP to be 162 and the dimensionless parameter $N_D$ to be $-2.83\times10^{-5}$. Accordingly, the efficiency design parameter EDP is calculated as being equivalent to $9\times10^{-5}$, which is considered to be in the optimum range.

With regard to semi-conducting fluid 30 utilized with the present invention, such fluid is preferably non-aqueous in order that spray droplets 28 formed therefrom are able to sustain the applied charge for a sufficient residence time (i.e., before striking collecting surface 38). Additionally, such fluid 30 should preferably be inert, non-volatile and non-toxic for obvious safety reasons. It has been found that such fluid should exhibit certain physical characteristics which enable it to be formed into spray droplets 28 of the desired size, provide the desired spray coverage within first chamber 24, and function effectively in attracting and retaining particles 20 as determined by calculation of the efficiency design parameter EDP.

Taking into account the desired functionality of fluid 30 as spray droplets 28, a formulation has been determined which measures what is known herein as a sprayability factor SF for a given fluid. First, a characteristic length CL of the fluid is determined from the following:

$$CL=[\{(PFS)^2\times(ST)\}/\{(D)\times(1/R)^2\times(10^7)\}]^{1/3}$$

Next, a characteristic flow rate CFR of the fluid is determined from the following:

$$CFR=[\{(PFS)\times(ST)\}/\{(D)\times(1/R)\times(10^5)\}]$$

and a property dependent parameter PDP is determined from the following:

$$PDP=[\{(ST)^3\times(PFS)^2\times(6\times10^3)\}/\{(V)^3\times(1/R)^2\times(FR)\}]^{1/3}$$

Then, should the property dependent parameter PDP be less than 1, the sprayablility factor SF is calculated from the following equation:

$$SF=[\log(CL)+\log[(1.6)\times((RDC)-1)^{1/6}\times[(FR)/\{(CFR)\times(6\times10^7)\}]^{1/3}-((RDC)-1)^{1/3}]]$$

If the property dependent parameter PDP is greater than 1, the sprayability factor SF is calculated from the following equation:

$$SF=-[\log(CL)+\log[(1.2)\times\{[(FR)/\{(CFR)\times(6\times10^7)\}]^{1/2}\}-0.3\ ]$$

It will be understood that the parameters identified in the above equations are as follows:

FR=flow rate (units of milliliters per minute)
D=density of liquid (units of kilograms per liter)
RDC=relative dielectric constant of fluid (dimensionless)
R=resistivity (units of ohm centimeters)
ST=surface tension of fluid (units Newtons per meter)
PFS=permittivity of free space (units of F/m)
V=viscosity of the liquid (units of Pascuals)

In conjunction with the above formulas, it has been found that an acceptable range for the sprayability factor SF is approximately 2.4–7.0, a preferred range for the sprayability factor SF is approximately 3.1–5.6, and an optimal range for sprayability factor SF is approximately 4.0–4.9.

In order to better appreciate the calculation of sprayability factor SF, an exemplary calculation follows for the spraying of propylene glycol (PG) at a flow rate of 0.3 mL/min. Propylene glycol has a density of 1.036 kg/L, a viscosity of 40 mPas, a surface tension of 38.3 mN/m, a resistivity of 10 Megaohm cm and a dielectric constant of 32. According to the foregoing equations, the characteristic length CL is calculated to be $3.045\times10^{-6}$, the characteristic flow rate CFR is calculated to be $3.19\times10^{-11}$, and the property dependent parameter PDP is calculated to be $5.03\times10^{-2}$. Since the PDP is less than one, the first equation for the sprayability factor SF is utilized and is determined to be 4.4 (in the optimal range). It will be appreciated that if the flow rate is increased to 3 mL/min, the sprayability factor SF is calculated to be 4.0, which is still within the optimal range of values.

In accordance with the above formulation, it has been found that preferred ranges for the indicated parameters are: viscosity of the fluid (V) has a range of approximately 1–100 milliPascals; surface tension of the fluid (ST) has a range of approximately 1–100 milliNewtons per meter; resistivity of the fluid (R) has a range of approximately 10 kilohm-50 Megaohm and a preferred range of approximately 1–5 Megaohm; and the electric field (E) is approximately 1–30 kilovolts per centimeter. The relative dielectric constant of fluids (RDC) preferred range is from 1.0 to 50.

Upon consideration of the above formulations and the requirements of fluid 30 to be utilized as spray 26, it has been found that the following class of fluids may be utilized: oils, silicones, mineral oil, cooking oils, polyols, polyethers, glycols, hydrocarbons, isoparafines, polyolefins, aromatic esters, aliphatic esters, fluorosurfactants, and mixtures thereof.

Of such fluids, it is preferred that the following types be utilized in apparatus 10: glycols, silicones, ethers, hydrocarbons and their substituted or unsubstituted oliogomers with molecular weight less than 400 and mixtures thereof. More preferred are the following: diethylene glycol monoethyl ether, triethylene glycol, tetraethylene glycol, tripropylene glycol, butylene glycol, and glycerol. It has also been found that certain mixtures containing such fluids is preferred in the following amounts: (1) 50% propylene glycol, 25% tetraethylene glycol, and 25% dipropylene glycol; (2) 50% tetraethylene glycol and 50% dipropylene glycol; (3) 80% triethylene glycol and 20% tetraethylene glycol; (4) 50% tetraethylene glycol and 20% 1,3 butylene glycol; and (5) 90% dipropylene glycol and 10% transcutol CG (diethylene glycol monomethyl ether).

Figure 19:
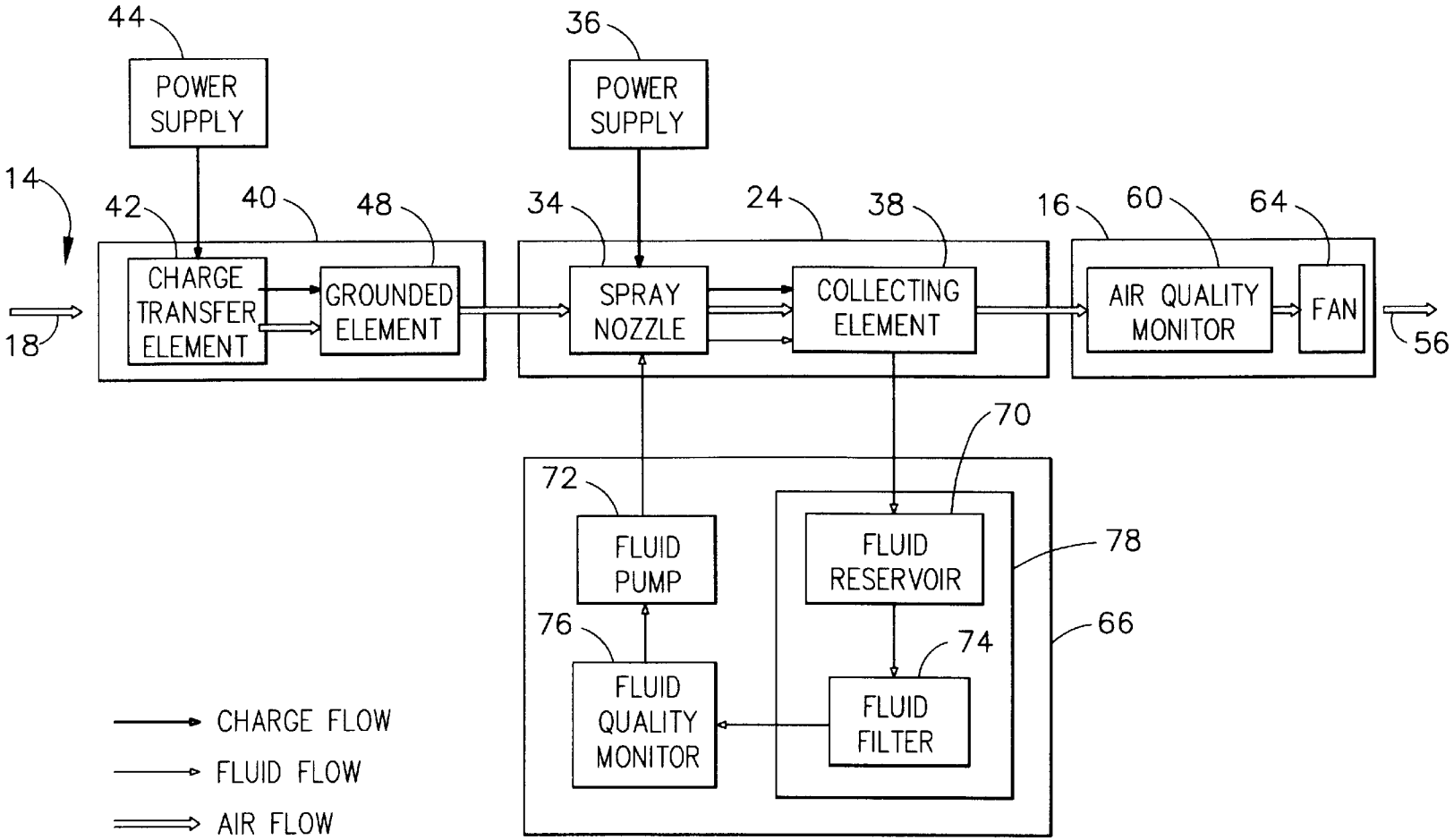
FIG. 19 is a block diagram of the air purification system depicted in FIGS. 1–4, where the flow of air, fluid and charge is indicated therein.

In order to better appreciate the process of the present invention, the charge flow, fluid flow and air flow within apparatus 10 are depicted in FIG. 19 by arrows of the following convention: bold arrows indicate charge flow; solid arrows indicate fluid flow; and, expanded arrows indicate air flow. In the preferred embodiment, it will be seen that air flow 18 passes through inlet 14 into second chamber 40, where particles 20 therein are charged at a desired polarity. Such air flow 18 is preferably filtered at inlet 14 by filter 22 so that particles therein having a size greater than about 10 microns are separated therefrom prior to entering second chamber 40. Air flow 18 may also be caused to have a turbulence within second chamber 40 so as to enhance the charging of particles 20. Air flow 18 then enters first chamber 24 and interfaces with spray droplets 28 therein so that particles 20 are electrostatically attracted thereto and removed from air flow 18. Finally, air flow 56 exits first chamber 24 and flows through outlet 16. Air flow 56 may again be filtered by filter 58 and the quality thereof is monitored by sensor 60 so as to determine the effectiveness of apparatus 10.

With regard to charge flow, it will be seen from FIG. 19 that a charge having a desired polarity (opposite to that of spray droplets 28) is provided to particles 20 in second chamber 40 by means of charge transfer element 42 and power supply 44. A charge having a polarity opposite that of the charge placed on particles 20 is provided to fluid 30 or spray droplets 28 by spray nozzle 34 and power supply 36 either before or after formation of spray droplets 28. Particles 20 are then attracted to spray droplets 28 and carried to collecting surface 38 in first chamber 24, whereupon the respective charges on particles 20 and spray droplets 28 are neutralized.

It will be seen in FIG. 19 that semi-conducting fluid 30 is provided to spray nozzle 34 so that spray droplets 28 are formed and provided into first chamber 24 as spray 26. Thereafter, spray droplets 28 are attracted to collecting surface 38, where they are preferably collected to form a fluid aggregate and recirculated to spray nozzle 34 via fluid recirculation system 66. This involves fluid 30 being collected in reservoir 70 and provided to spray nozzle 34 by pump mechanism 72. As shown in FIG. 19, it is preferred that such fluid 30 have particles 20 filtered therefrom by filter 74 and the quality of such fluid 30 monitored by device 76 prior to entering pump mechanism 72.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention.

What is claimed is:

1. An apparatus for removing particles from air, comprising:

(a) at least one inlet for receiving a flow of air, containing entrained particles;

(b) a first chamber in flow communication with said inlet, wherein an electrostatically charged spray of semi-conducting, non-aqueous, fluid droplets having a first polarity is introduced to said air flow passing therethrough so that said particles are electrostatically attracted to and retained by said spray droplets; and (c) an outlet in flow communication with said first chamber, wherein said air flow exits said apparatus substantially free of said particles.

2. The apparatus of claim 1, said first chamber further comprising a collecting surface for attracting said spray droplets.

3. The apparatus of claim 2, wherein said collecting surface is grounded.

4. The apparatus of claim 2, wherein said collecting surface is charged at a second polarity opposite said first polarity.

5. The apparatus of claim 2, said first chamber further comprising:

(a) a first device for forming said spray droplets from said fluid; and (b) a second device for charging said spray droplets.

6. The apparatus of claim 2, said first chamber further comprising:

(a) a power supply; and (b) a spray nozzle connected to said power supply for receiving fluid, producing said spray droplets therefrom, and charging said spray droplets.

7. The apparatus of claim 1, further comprising a second chamber in flow communication with said inlet at a first end and said first chamber at a second end, wherein said particles entrained in said air flow are charged with a second polarity opposite said first polarity prior to said air flow entering said first chamber.

8. The apparatus of claim 7, said second chamber further comprising:

(a) a power supply;

(b) at least one charge transfer element connected to said power supply for creating an electric field in said second chamber; and (c) a ground element associated with said second chamber for defining and directing said electric field, wherein said air flow passes between said charge transfer element and said ground element.

9. The apparatus of claim 6, wherein said collecting surface is spaced from said spray nozzle by a predetermined distance so that charge on said spray droplets is maintained until striking said collecting surface.

10. The apparatus of claim 1, further comprising a device located adjacent to said inlet for directing said air flow into said first chamber.

11. The apparatus of claim 1, wherein said particles have a specified size of approximately 0.1–10 microns.

12. The apparatus of claim 11, further comprising a filter located adjacent to said inlet for collecting particles in said air flow having a size greater than said specified size.

13. The apparatus of claim 1, further comprising a filter located adjacent to said outlet for removing any spray droplets not collected in said first chamber.

14. The apparatus of claim 1, further comprising a device located adjacent to said outlet for directing said air flow from said inlet through said first chamber.

15. The apparatus of claim 1, further comprising a device located adjacent to said outlet for monitoring quality of said air flow upon exiting said apparatus.

16. The apparatus of claim 5, further comprising a fluid recirculation system in flow communication with said first chamber for providing said fluid from said collecting surface to said first device.

17. The apparatus of claim 16, said fluid recirculation system further comprising:

(a) a reservoir in flow communication with said collecting surface; and (b) a pump for providing said fluid to said spray nozzle.

18. The apparatus of claim 17, said fluid recirculation system further comprising a filter positioned between said collecting surface and said first device for removing said particles from said fluid.

19. The apparatus of claim 17, said fluid recirculation system further comprising a device for monitoring quality of said fluid prior to being pumped to said spray nozzle.

20. The apparatus of claim 1, further comprising an air passage associated with said first chamber for assisting in the formation of said spray droplets.

21. The apparatus of claim 1, said spray droplets having a size in a range of approximately 0.1–1000 microns.

22. The apparatus of claim 1, wherein said spray flows in a direction at an angle to said air flow.

23. The apparatus of claim 1, wherein said spray flows in a direction substantially opposite to said air flow.

24. The apparatus of claim 1, wherein said spray flows in a direction substantially the same as said air flow.

25. An apparatus for removing particles from air, comprising:

(a) at least one defined passage having an inlet and an outlet, wherein each said inlet receives a flow of air and said air flow exits said at least one defined passage at each said outlet;

(b) a first volume positioned between each said inlet and each said outlet wherein an electrostatically charged spray of semi-conducting, non-aqueous fluid droplets having a first polarity is introduced within said at least one defined passage so that particles entrained within said air flow are electrostatically attracted to and retained by said spray droplets; and (c) a collecting surface associated with said first volume of said at least one defined passage for attracting said spray droplets.

26. The apparatus of claim 25, further comprising a second volume positioned between said inlet and said first volume, wherein particles entrained in said air flow are charged with a second polarity opposite said first polarity.

27. A method of removing particles from air, comprising the following steps:

(a) introducing a flow of air having particles entrained therein into a defined volume;

(b) providing an electrostatically charged spray of semi-conducting, non-aqueous fluid droplets having a first polarity to said defined volume, wherein said particles are electrostatically attracted to and retained by said spray droplets; and (c) attracting said spray droplets to a collecting surface.

28. The method of claim 27, further comprising the step of forming said spray droplets from said fluid.

29. The method of claim 28, further comprising the step of charging said spray droplets.

30. The method of claim 27, further comprising the step of providing a charge to particles in said air flow at a second polarity opposite said first polarity.

31. The method of claim 27, wherein said particles in said air flow are within a specified size range of approximately 0.1–10 microns.

32. The method of claim 31, further comprising the step of filtering said air flow for particles having a size greater than said specified size range.

33. The method of claim 27, further comprising the step of monitoring quality of said air flow.

34. The method of claim 27, further comprising the step of filtering said particles from said spray droplets.

35. The method of claim 27, further comprising the following steps:

(a) collecting said spray droplets in an aggregate of said fluid; and (b) recirculating said fluid aggregate for use in said spray.

36. The method of claim 35, further comprising the step of monitoring a quality of said recirculated fluid prior to forming said spray.

* * * * *

UNITED STATES PATENT AND TRADEMARK OFFICE

CERTIFICATE OF CORRECTION

PATENT NO. : 6,607,579 B2
DATED : August 19, 2003
INVENTOR(S) : Willey et al.

It is certified that error appears in the above-identified patent and that said Letters Patent is hereby corrected as shown below:

Column 9,
Line 50, delete "Z=cos[arctanx $V_2/V_1$)]." and insert therefor
-- Z=cos[arctan ($V_2/V_1$)]. --

Column 10,
Line 7, delete "c = 1 micron" and insert therefor -- c = 1 :m --.

Signed and Sealed this

Twenty-eighth Day of June, 2005

JON W. DUDAS
*Director of the United States Patent and Trademark Office*